US012630335B2

(12) United States Patent
Coombe

(10) Patent No.: US 12,630,335 B2
(45) Date of Patent: May 19, 2026

(54) STACKABLE IRON BASKETS

(71) Applicant: ENERCORP ENGINEERED SOLUTIONS INC., Calgary (CA)

(72) Inventor: Brent James William Coombe, Calbary (CA)

(73) Assignee: ENERCORP ENGINEERED SOLUTIONS INC., Calgary (CA)

( * ) Notice: Subject to any disclaimer, the term of this patent is extended or adjusted under 35 U.S.C. 154(b) by 0 days.

(21) Appl. No.: 18/598,045

(22) Filed: Mar. 7, 2024

(65) Prior Publication Data

US 2024/0300695 A1 Sep. 12, 2024

Related U.S. Application Data

(60) Provisional application No. 63/488,878, filed on Mar. 7, 2023.

(51) Int. Cl.
*B65D 25/22* (2006.01)
*B65D 21/02* (2006.01)

(52) U.S. Cl.
CPC ..... *B65D 21/0215* (2013.01); *B65D 25/22* (2013.01)

(58) Field of Classification Search
CPC ..... B65D 2519/0097; B65D 2519/00298
See application file for complete search history.

(56) References Cited

U.S. PATENT DOCUMENTS

D362,945 S 10/1995 Glinski
D363,587 S 10/1995 Glinski
5,692,625 A * 12/1997 Filipescu ..... A47F 5/108 211/85.5
D446,052 S 8/2001 Bourne
7,997,213 B1 * 8/2011 Gauthier ..... B65D 88/022 294/67.1
D682,595 S 5/2013 Altier
D771,275 S 11/2016 Yarter
D793,647 S 8/2017 Kueck
D839,526 S 1/2019 Stauffer et al.
D847,375 S 4/2019 Trudell
D905,374 S 12/2020 Estrella et al.
(Continued)

FOREIGN PATENT DOCUMENTS

DE 202020101820 U1 * 5/2020 ..... B65D 19/10

OTHER PUBLICATIONS

English translation of DE202020101820 (Year: 2020).*
(Continued)

*Primary Examiner* — Don M Anderson
(74) *Attorney, Agent, or Firm* — Grollitsch Law, PLLC

(57) ABSTRACT

A modular stack includes a plurality of baskets including at least a first basket and a second basket. The second basket is configured to be stacked on the first basket such that the first and second baskets occupy a same footprint. The first and second baskets each include a base frame that is substantially rectangular. The first and second baskets also each include a bottom extending across a lower portion of the base frame. The first and second baskets also each include one or more cross-members extending over the bottom from a first side of the base frame to a second side of the base frame. The first and second baskets also each include a side plate extending upward from the first side. The side plate is connected to the base frame and the one or more cross-members.

13 Claims, 5 Drawing Sheets

(56) References Cited

U.S. PATENT DOCUMENTS

| | | | | |
|---|---|---|---|---|
| D963,984 | S | 9/2022 | Robinson | |
| D1,007,803 | S | 12/2023 | Buscema | |
| D1,031,202 | S | 6/2024 | Hassell et al. | |
| D1,066,858 | S | 3/2025 | Alderman | |
| 2004/0007550 | A1 | 1/2004 | Leeman et al. | |
| 2004/0195127 | A1* | 10/2004 | Beck | B65D 19/12 206/335 |
| 2006/0278637 | A1* | 12/2006 | Gao | B65D 19/02 220/6 |
| 2010/0078399 | A1 | 4/2010 | Higueroa et al. | |
| 2016/0052670 | A1* | 2/2016 | Skeid | B65D 19/06 108/52.1 |
| 2019/0104845 | A1* | 4/2019 | Gerraty | B65D 19/10 |
| 2021/0284386 | A1* | 9/2021 | Heinzmann | B65D 19/08 |
| 2022/0204211 | A1* | 6/2022 | Ranly | B65D 19/12 |
| 2024/0300695 | A1 | 9/2024 | Coombe | |

OTHER PUBLICATIONS

"10 Pcs Plastic Pallets," Posted on amazon.com, First Available Date Jan. 16, 2025, Retrieved Online on Mar. 14, 2025, https://amazon.com/dp/BODT5ZPJZ8/ (Year: 2025).

"Sandbaggy Heavy-Duty Stackable Pallet Racks," Posted Online on amazon.com, First Available Date Aug. 13, 2024, Retrieved Online on Mar. 14, 2025, https://www.amazon.com/Sandbaggy-Heavy-Duty-Stackable-Powder-Coated-Forklift/dp/BODD5NCPSM?th=1 (Year: 2024).

"Transport Storage Stacking Shelving Movable Pipe Hose Storage Rack Pipe System," Posted Online on alibaba.com, Store Review Date Apr. 17, 2024, Retrieved Online on Mar. 14, 2025, https://alibaba.com/product-detail/Transport-storage-stacking-shelving-movable-pipe_62230346561.html (Year: 2024).

"Post Stillage," Posted Online on cqegroup.com, Wayback Machine Date Dec. 9, 2024, Retrieved Online on Mar. 14, 2025, https://web.archive.org/web/20241209172159/https://cqegroup.com/au/product/site-equipment/post-stillage/ (Year: 2024).

* cited by examiner

STACKABLE IRON BASKETS

CROSS-REFERENCE TO RELATED APPLICATIONS

This application claims priority to U.S. Provisional Patent Application No. 63/488,878, filed on Mar. 7, 2024, which is incorporated by reference.

BACKGROUND

In many industries, but particularly in the oilfield industry, a large number of tubulars (e.g., pipes and/or fittings) may be transported over long distances to arrive at a worksite. Because oilfield applications often call for large, high-strength steel pipes and associated fittings in large quantities, the material being transported can be heavy. Moreover, because the couplings may have various different shapes/sizes, they may not be easily stored or stacked together.

Typically, such tubulars are loaded into a rack in a skid of some configuration and arranged (e.g., parallel and in a horizontal configuration). The fittings, however, are often simply stacked loose in the skid, potentially in several layers. These loose fittings, in addition to potentially not being efficiently stored with a suitable packing factor, may be prone to shifting during unloading. Given the aforementioned heavy weight of the couplings and other fittings, this can present a hazard to personnel responsible for unloading the materials (e.g., creating the potential for crushing-type injuries if the pile of loose fittings shifts).

SUMMARY

Embodiments of the disclosure include a modular stack that includes one or more first baskets configured to receive a plurality of fittings, the one or more first baskets including posts and guides, the guides each received into a respective post. The stack also includes one or more second baskets configured to receive a plurality of tubulars that connect with at least some of the plurality of fittings. The one or more second baskets each include posts and guides, the guides of the one or more second baskets received into the posts of the one or more second baskets. The one or more first baskets are configured to stack on the one or more second baskets, such that the guides of the one or more second baskets are received into the posts of the one or more first baskets. The one or more second baskets are configured to stack on the one or more first baskets, such that the guides of the one or more first baskets are received into the posts of the one or more second baskets. The one or more first baskets and the one or more second baskets are configured to be lifted independently of one another.

Embodiments of the disclosure also include a method including lifting a stack of baskets as a single unit from a transport vehicle, the stack including a plurality of baskets each having a post with a guide received therein that is also received into a post of a superposed basket, lifting a first basket of the baskets off the stack, the first basket being configured to hold a plurality of tubulars, positioning the first basket on the ground, lifting a second basket of the baskets off the stack after positioning the first basket on the ground, the second basket being configured to hold a plurality of fittings for the pipes, and positioning the second basket adjacent to the first basket on the ground.

Embodiments of the disclosure also include a modular stack that includes a plurality of baskets including at least a first basket and a second basket. The second basket is configured to be stacked on the first basket such that the first and second baskets occupy a same footprint. The first and second baskets each include a base frame that is substantially rectangular. The first and second baskets also each include a bottom extending across a lower portion of the base frame. The first and second baskets also each include one or more cross-members extending over the bottom from a first side of the base frame to a second side of the base frame. The first and second baskets also each include a side plate extending upward from the first side. The side plate is connected to the base frame and the one or more cross-members. The first and second baskets also each include a post extending vertically from a corner of the base frame. The first and second baskets also each include a guide at an upper end of the post. The guide of the first basket is configured to be inserted into a lower end of the post of the second basket.

Embodiments of the disclosure also include a modular stack including a plurality of baskets including at least a first basket and a second basket. The second basket is configured to be stacked on the first basket such that the first and second baskets occupy a same footprint. The first and second baskets each include a base frame that is substantially rectangular. The first and second baskets also each include a bottom extending across a lower portion of the base frame. The first and second baskets also each include one or more cross-members extending over the bottom from a first side of the base frame to a second side of the base frame. The first and second baskets also each include a side plate extending upward from the first side. The side plate is connected to the base frame and the one or more cross-members. The first and second baskets also each include a post extending vertically from a corner of the base frame. The first and second baskets also each include a guide at an upper end of the post. The guide of the first basket is configured to be inserted into a lower end of the post of the second basket. The guide includes a first plate and a second plate. The first plate defines a first slot for receiving a portion of the second plate. The second plate defines a second slot for receiving a portion of the first plate. Upper ends of the first and second plates of the guide of the first basket are tapered to facilitate insertion into the lower end of the post of the second basket. The guide of the first basket includes a landing stop that is configured to engage the upper end of the post of the first basket to prevent the guide of the first basket from falling through the post of the first basket.

Embodiments of the disclosure also include a method including lifting a stack from a transport vehicle using a lifting mechanism. The stack includes a plurality of baskets including at least a first basket and a second basket. The second basket is positioned on the first basket such that the first and second baskets occupy a same footprint. The first and second baskets each include a base frame that is substantially rectangular. The first and second baskets also each include a post extending vertically from a corner of the base frame. The first and second baskets also each include a guide at an upper end of the post. The guide of the first basket is configured to be inserted into a lower end of the post of the second basket to form the stack. The method also includes positioning the stack on the ground at a first location using the lifting mechanism. The method also includes lifting the second basket from the first basket using the lifting mechanism while the first basket remains on the ground. The method also includes positioning the second basket on the ground at a second location using the lifting mechanism. The second location is different than the first location.

BRIEF DESCRIPTION OF THE DRAWINGS

The present disclosure may best be understood by referring to the following description and the accompanying drawings that are used to illustrate embodiments of the invention. In the drawings.

DETAILED DESCRIPTION

Figure 1:
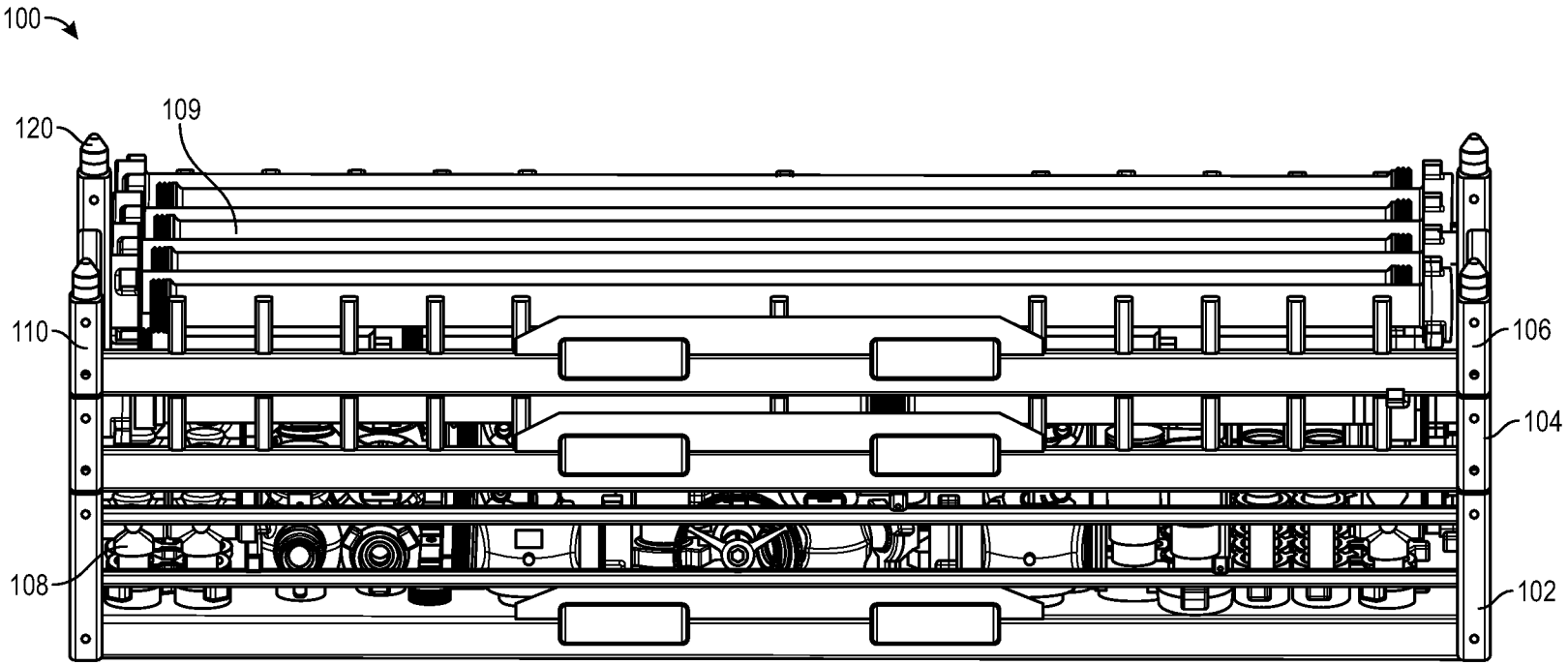
FIG. 1 illustrates a perspective view of a modular stack of baskets for transporting oilfield tubulars and fittings for oilfield tubulars, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a modular stack 100 for transporting oilfield tubulars and fittings, according to an embodiment. The stack 100 in this example includes three different stackable baskets 102, 104, 106. Each basket 102-106 may occupy a similar (e.g., the same) footprint in the horizontal plane (e.g., have roughly the same length and width). This may facilitate stacking the baskets 102-106 vertically, one on top of the other, to build the stack 100. The heights of the different baskets 102-106 may vary. For example, the basket 102 may be taller than the baskets 104, 106. Further, the configurations of the baskets 102-106 may differ (e.g., according to their intended use and/or other, design considerations). For example, the basket 102 may be configured to contain fittings 108, while the baskets 104, 106 may be configured to provide a horizontal pipe rack that stores pipes 109 therein. Accordingly, the baskets 104, 106 may be a first type of basket, while the basket 102 may be a second type of basket, with the first and second types of baskets being stackable together, and independently movable, as shown.

Each of the baskets 102-106 may have a corner post 110 positioned at each of its corners (e.g., in a rectangular embodiment of the baskets 102-106). It will be appreciated that this is merely an example, and any other arrangement of posts 110 could be suitably used (e.g., including center posts, posts along a periphery of a cylindrical embodiment of the baskets 102-106, etc.). A post guide 120 may be inserted into the top of each of the corner posts 110. The post guide 120 may stab into the bottom of a corner post 110 of a next-higher one of the baskets 102-106. In the illustrated stacked arrangement, only the guides 120 for the basket 106 are visible, with it being appreciated that the guides 120 for the subjacent (e.g., lower) baskets 102-104 are located within the corner posts 110 thereof.

Figure 2:
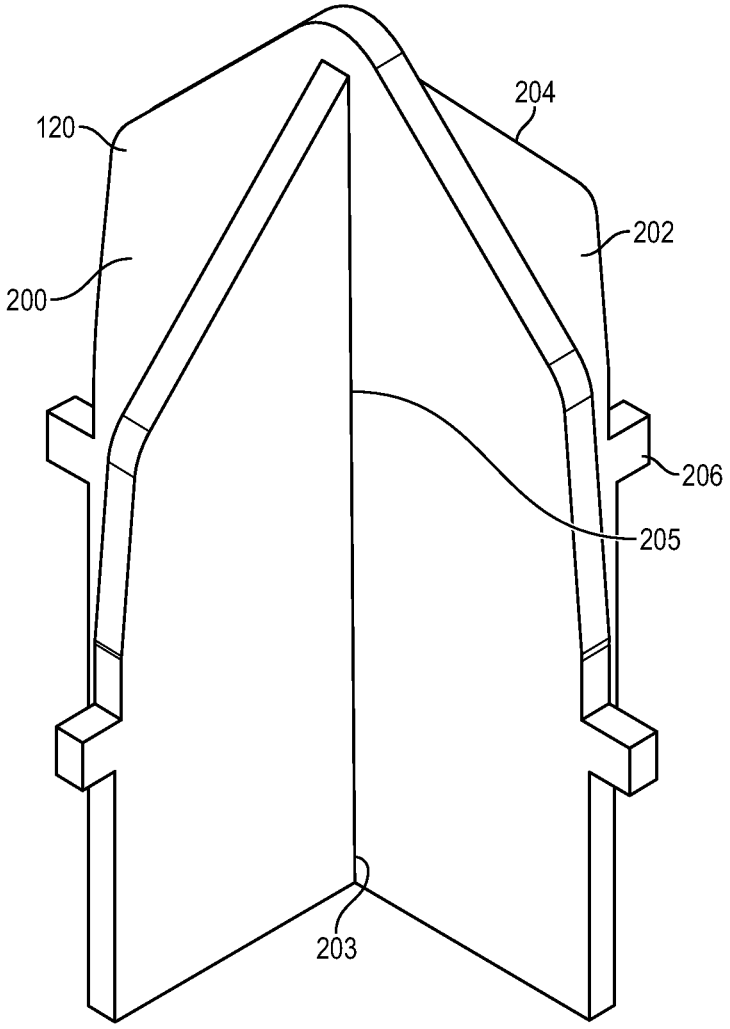
FIG. 2 illustrates a perspective view of a guide for the modular stack of baskets, according to an embodiment.

FIG. 2 illustrates a perspective view of one of the guides 120, according to an embodiment. As illustrated, the guide 120 may be formed from two slotted plates 200, 202. Each plate 200, 202 may include a slot 203, 205, respectively, formed in the middle thereof, permitting a cross-shaped cross section to be formed. With additional reference to FIG. 1, an upper end 204 of the guide 120 may be tapered, so as to facilitate insertion thereof into the corner post 110 of a superposed (e.g., upper) basket 102-106 as the superposed basket 102-106 is lowered into position. Accordingly, the geometry of the guide 120 may facilitate bringing the superposed basket 102-106 into alignment with the subjacent basket 102-106 as the superposed basket 102-106 is lowered onto the subjacent basket 102-106. In at least some embodiments, the guide 120 may be cylindrical, with a conical upper end 204 providing the tapered geometry and function, as discussed above.

The guide 120 may also include landing stops 206, which may engage the top of the corner post 110 of one of the subjacent baskets 102-106 when the guide 120 is inserted therein, preventing the guide 120 from falling through the corner post 110. The corner post 110 of the superposed basket 102-106 may thus rest on the landing stops 206 when received into position in the stack 100, on top of the subjacent basket 102-106.

Figure 3:
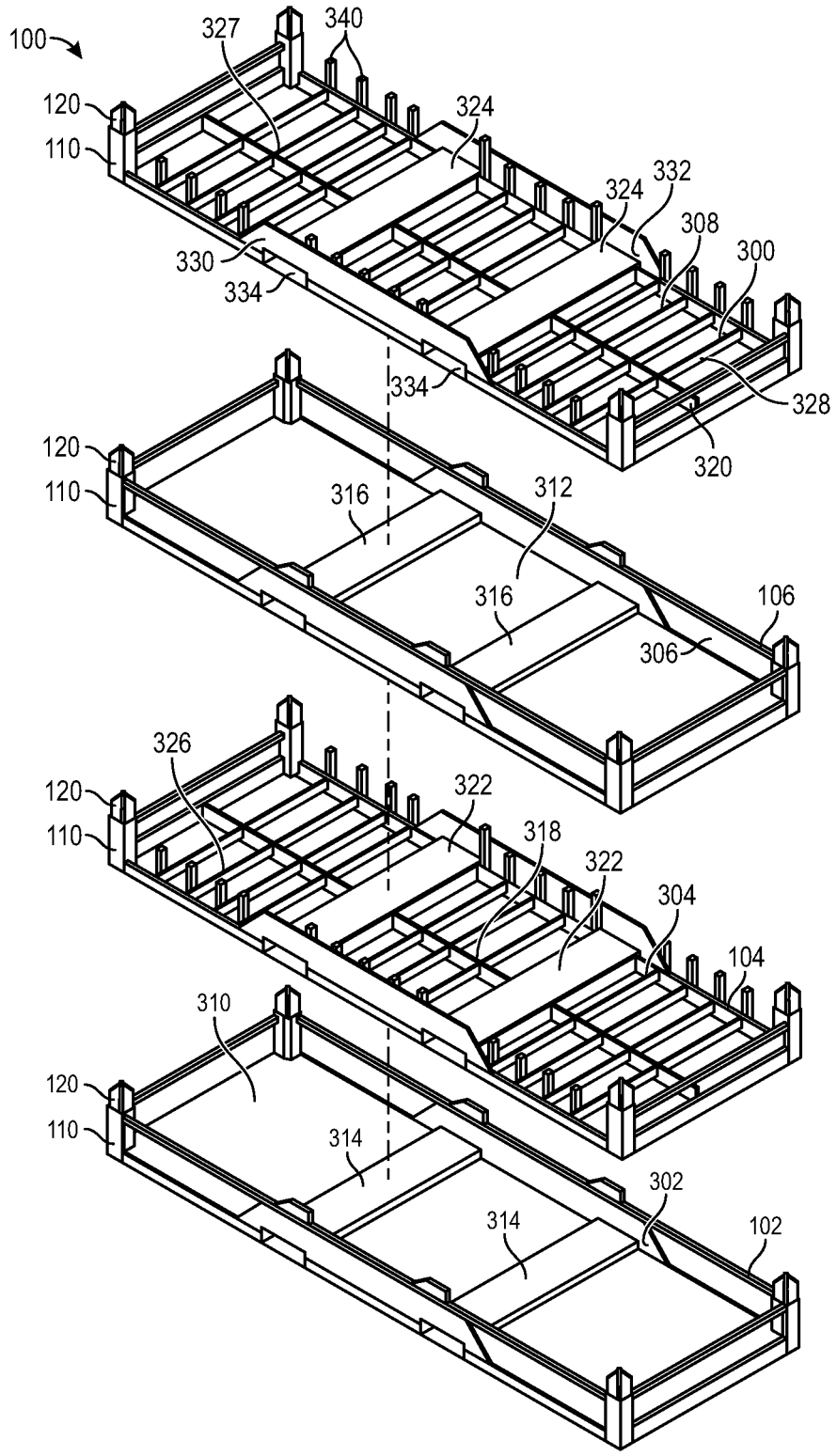
FIG. 3 illustrates a perspective, exploded view of the modular stack of baskets, according to an embodiment.

FIG. 3 illustrates an exploded view of the stack 100, according to another embodiment. In addition to the baskets 102-106, this embodiment of the stack 100 includes a fourth basket 300, while the first basket 102 is of generally equal height to the other baskets 104, 106, 300, rather than taller, as in the embodiment of FIG. 1. Any combination of features of the embodiments of FIGS. 1 and 3 is contemplated herein. As shown, each of the baskets 102-106, 300 includes four corner posts 110 with guides 120 positioned therein, as described above. Further, each of the baskets 102-106, 300 may have a base frame 302, 304, 306, 308.

The baskets 102, 106 may have solid bottoms 310, 312 with cross-members 314, 316 extending over the bottoms 310, 312, between the respective frames 302, 306. The baskets 104, 300 may each include a center support 318, 320 and two cross-members 322, 324 that extend perpendicular to the center support 318, 320. The center support 318, 320 and the cross-members 322, 324 may each connected to the respective frames 304, 308. The second and fourth baskets 104, 300 may also include a plurality of smaller cross-members 326, 327 (e.g., connecting the frames 304, 308 to the respective center support 318, 320).

Each of the baskets 102-106, 300 may also include a pair of side plates 330, 332 (e.g., as indicated for the basket 300, but applying to the other baskets 102-106 as well). The side plates 330, 332 may be connected to the frames 302-308 as well as the cross-members 314, 316, 322, 324. The side plates 330, 332 may extend upwards along at least a part of the height of the basket 102-106, 300, such that the side plates 330, 332 of a subjacent basket 102-108, 300 may engage the frame 302-308 of a superposed basket 102-108, 300. In some embodiments, the side plates 330, 332 may extend upward only a portion of the height of the baskets 102-106, 300, however. Further, the side plates 330, 332 may not extend across the entire length of the baskets 102-106, 300, but may be located generally in the middle thereof.

The side plates 330, 332 may each define a pair of openings 334 therein (e.g., as indicated for the basket 300, but applying to the other baskets 102-106 as well). The cross-members 324 may extend from the openings 334 (e.g., between and through the two side plates 330, 332). The cross-members 324 may be at least partially hollow. Accordingly, the openings 334 and the cross-members 324 may provide a connection for a lifting mechanism. For example, a fork of a forklift may be inserted into the openings 334 and at least partially through the cross-members 324. In other embodiments, other lifting attachments may be provided (e.g., hooks, etc.) for attachment to cranes/hoisting mechanisms. The baskets 102-106 may likewise include connections for a lifting mechanism.

The baskets 102, 106 may be configured for holding pipe fittings, couplings, etc. For example, because of the solid bottoms 310, 312, the baskets 102, 106 may be able to carry relatively small articles, such as the fittings/couplings. However, the baskets 102, 106 being stackable may limit a height of the materials therein, and may, for example, limit or preclude stacking of loose articles therein, thereby reducing the shifting hazard described above. Thus, instead of stacking the loose articles, operators can stack multiple baskets 102, 106.

The baskets 106, 300 may be configured to hold tubulars therein (e.g., pipes). The lack of a solid base, with smaller cross-members 326 and a center support 318, 320 used instead may thus reduce weight. It will be appreciated that upright members 340 may also be provided. The upright members 340 may be connected to the smaller cross-members 328 (e.g., to prevent the pipes loaded into the baskets 106, 300 from rolling out of the side thereof).

Figure 4:
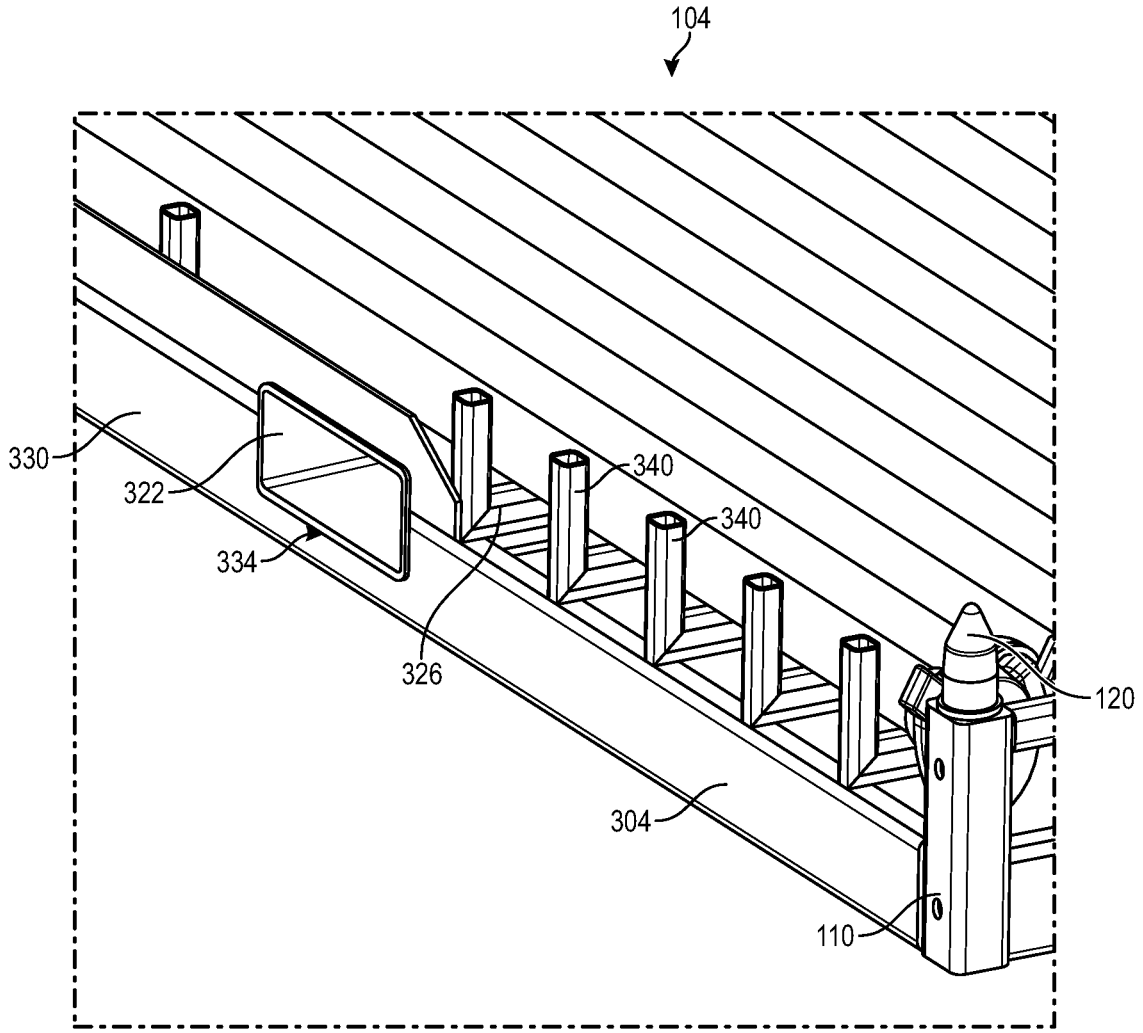
FIG. 4 illustrates a perspective, partial view of one of the baskets of the stack of baskets, according to an embodiment.

FIG. 4 illustrates a perspective view of part of the basket 104, according to an embodiment. As shown, the openings 334 may not be flush with the bottom of the base 304. Rather, these openings 334, and the cross-members (only cross-member 322 is visible, through the opening 334) that extend therefrom are offset upwards from the bottom of the base 304. This may provide a convenient vertical spacing from the ground (or another surface upon which a lowest basket might be positioned) that facilitates insertion of the lifting device (e.g., a fork of a forklift, lines/straps for a hoist, etc.). It will be appreciated that the other baskets 102, 106, 300, and/or others as may be added to the stack 100, may similarly have offset openings 334, or may be otherwise configured.

Moreover, and referring again to FIG. 3, by providing lift attachment points (e.g., the openings 334 and cross-members 324) in each of the baskets 102-106, 300, the baskets 102-106, 300 may thus be individually moved from the stack 100 and/or the stack 100 may be moved as a single unit (e.g., by lifting the lowest basket 102 of the stack 100).

For example, the stack 100 may be initially on a truck or another transport vehicle, and may be lifted as a single unit and placed on the ground. The individual baskets 102-106, 300 may then be separated by a forklift and placed on the ground. For example, the basket 300 may be lifted and placed in a particular location on the ground, and then the basket 106 may be lifted and placed adjacent to the basket 300. In such case, baskets 102-106, 300 holding like-equipment may be staged for convenient use in staging areas. For example, all the baskets 102-106, 300 holding valves may be set in a group (e.g., adjacent to one another on the ground), and all the baskets 102-106, 300 holding pipes of a particular size could be set in another group. When an order for a certain number of pipes and valves is received, operators may pick the ordered components within the baskets arranged in the separate groups, create a new stack 100 with the appropriate baskets 102-106, 300, and then deploy the stack 100 by lifting it as a single unit or stacking the baskets together on the transport vehicle.

Figure 5:
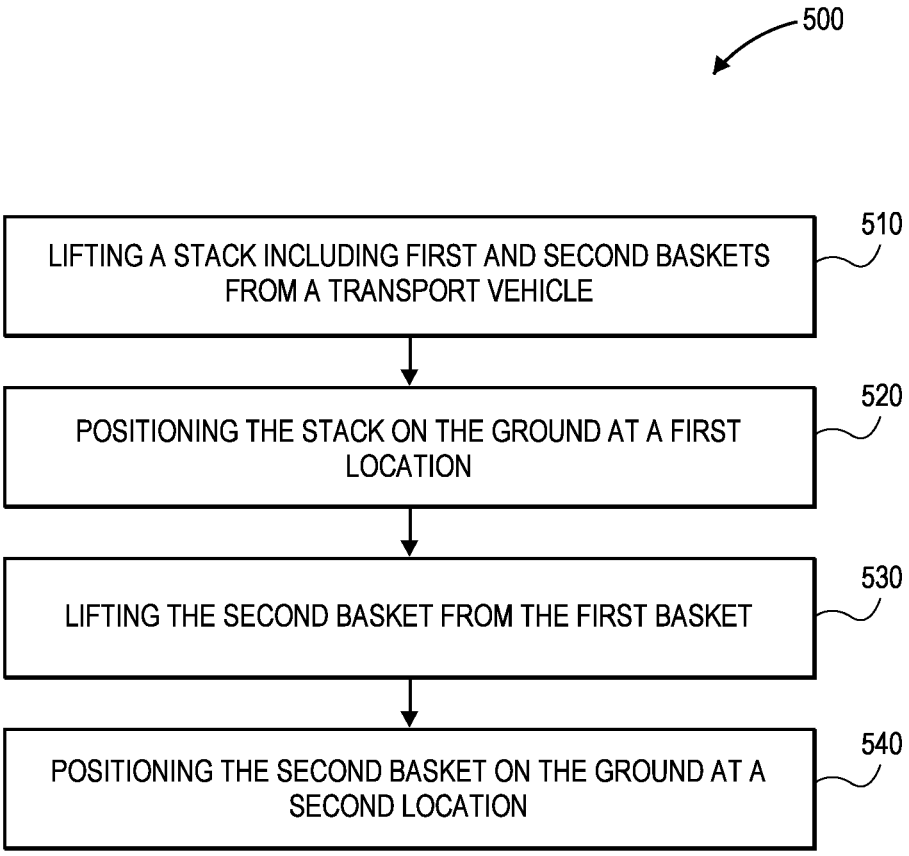
FIG. 5 illustrates a flowchart of a method for assembling and/or using the modular stack of baskets, according to an embodiment.

FIG. 5 illustrates a flowchart of a method 500 for assembling and/or using a modular stack of baskets, according to an embodiment. An illustrative order of the method 500 is provided below; however, one or more steps of the method 500 may be performed in a different order, simultaneously, repeated, or omitted.

The method 500 may include lifting a stack 100 from a transport vehicle, as at 510. The stack 100 may be lifted using a lifting mechanism (e.g., a forklift). As discussed above, the stack 100 may include plurality of baskets 102-106, 300 including at least a first basket (e.g., 102) and a second basket (e.g., 104). The second basket 104 may be positioned on/above the first basket 102 such that the first and second baskets 102, 104 occupy a same footprint. In one embodiment, lifting the first basket 102 may include inserting a portion of the lifting mechanism into the first and second openings 334 and/or the first and second cross-members 314 of the first basket 102.

The method 500 may also include positioning the stack 100 on the ground at a first location, as at 520. The stack 100 may be positioned using the lifting mechanism.

The method 500 may also include lifting the second basket 104 from the first basket 102, as at 530. The second basket 104 may be lifted using the lifting mechanism while the first basket 102 remains on the ground. In one embodiment, lifting the second basket 104 may include inserting the portion of the lifting mechanism into the first and second openings 334 and/or the first and second cross-members 322 of the second basket 104. Lifting the second basket 104 may also or instead include removing the guide 120 of the first basket 102 from the lower end of the post 110 of the second basket 104.

The method 500 may also include positioning the second basket 104 on the ground at a second location, as at 540. The second basket 104 may be positioned using the lifting mechanism. The second location may be different than the first location.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A modular stack, comprising:

a plurality of baskets including at least a first basket and a second basket, wherein the second basket is configured to be stacked on the first basket such that the first and second baskets occupy a same footprint, and wherein the first basket comprises:

a base frame that is substantially rectangular;

a bottom extending across a lower portion of the base frame;

one or more cross-members extending over the bottom from a first side of the base frame to a second side of the base frame;

a side plate extending upward from the first side, wherein the side plate is connected to the base frame and the one or more cross-members, a post extending vertically from a corner of the base frame; and a guide at an upper end of the post, wherein the guide of the first basket is configured to be inserted into a lower end of a post of the second basket.

2. The modular stack of claim 1, wherein the first basket and the second basket are configured to be lifted independently of one another.

3. The modular stack of claim 1, wherein the guide comprises a first plate and a second plate that are substantially perpendicular to one another, wherein the first plate defines a first slot for receiving a portion of the second plate, and wherein the second plate defines a second slot for receiving a portion of the first plate.

4. The modular stack of claim 3, wherein upper ends of the first and second plates of the guide of the first basket are tapered to facilitate insertion into the lower end of the post of the second basket, and wherein the guide of the first basket comprises a landing stop that is configured to engage the upper end of the post of the first basket to prevent the guide of the first basket from falling through the post of the first basket.

5. The modular stack of claim 1, wherein the bottom of the first basket is solid, and wherein a bottom of the second basket is non-solid and defines one or more openings therein to reduce a weight thereof.

6. The modular stack of claim 1, wherein the side plate extends less than a length of the first side.

7. The modular stack of claim 1, wherein the side plate extends upward less than a height of the basket of which it is a part.

8. The modular stack of claim 1, wherein the side plate defines at least two openings, wherein the at least two openings are positioned above the bottom, wherein the one or more cross-members extend from the at least two openings, and wherein the one or more cross-members are hollow to receive a connection for a lifting mechanism.

9. The modular stack of claim 1, wherein the second basket comprises:

a base frame that is substantially rectangular;

one or more cross-members extending from a first side of the base frame to a second side of the base frame;

a center support extending from a first end of the base frame to a second end of the base frame, and wherein the one or more cross-members are perpendicular to the center support.

10. A modular stack, comprising:

a plurality of baskets including at least a first basket and a second basket, wherein the second basket is configured to be stacked on the first basket such that the first and second baskets occupy a same footprint, and wherein the first basket comprises:

a base frame that is substantially rectangular;

a bottom extending across a lower portion of the base frame;

one or more cross-members extending over the bottom from a first side of the base frame to a second side of the base frame;

a side plate extending upward from the first side, wherein the side plate is connected to the base frame and the one or more cross-members, a post extending vertically from a corner of the base frame; and a guide at an upper end of the post, wherein the guide of the first basket is configured to be inserted into a lower end of a post of the second basket, wherein the guide comprises a first plate and a second plate, wherein the first plate defines a first slot for receiving a portion of the second plate, wherein the second plate defines a second slot for receiving a portion of the first plate, wherein upper ends of the first and second plates of the guide of the first basket are tapered to facilitate insertion into the lower end of a post of the second basket, and wherein the guide of the first basket comprises a landing stop that is configured to engage the upper end of the post of the first basket to prevent the guide of the first basket from falling through the post of the first basket.

11. The modular stack of claim 10, wherein the bottom of the first basket is solid, and wherein a bottom of the second basket is non-solid and defines one or more openings therein to reduce a weight thereof.

12. The modular stack of claim 10, wherein the side plate extends less than a length of the first side, wherein the side plate extends upward less than a height of the basket of which it is a part, wherein the side plate defines at least two openings, wherein the at least two openings are positioned above the bottom, wherein the one or more cross-members extend from the at least two openings, and wherein the one or more cross-members are hollow to receive a connection for a lifting mechanism.

13. The modular stack of claim 10, wherein the second baskets comprises:

a base frame that is substantially rectangular;

one or more cross-members extending from a first side of the base frame to a second side of the base frame;

a center support extending from a first end of the base frame to a second end of the base frame, and wherein the one or more cross-members are perpendicular to the center support.

* * * * *